US006470531B2

(12) United States Patent
Domenig et al.

(10) Patent No.: US 6,470,531 B2
(45) Date of Patent: Oct. 29, 2002

(54) ADJUSTABLE HINGE

(75) Inventors: Georg Domenig, Kernersville, NC (US); Manfred Peer, Walkertown, NC (US)

(73) Assignee: Grass America, Inc., Kernersville, NC (US)

( * ) Notice: Subject to any disclaimer, the term of this patent is extended or adjusted under 35 U.S.C. 154(b) by 0 days.

(21) Appl. No.: 09/860,687

(22) Filed: May 18, 2001

(65) Prior Publication Data

US 2001/0047568 A1 Dec. 6, 2001

Related U.S. Application Data

(63) Continuation-in-part of application No. 09/434,087, filed on Nov. 5, 1999, now Pat. No. 6,240,599.

(51) Int. Cl.[7] ..... E05D 7/04

(52) U.S. Cl. ..... 16/240; 16/241; 16/242; 16/246

(58) Field of Search ..... 16/240, 241, 242, 16/238, 239, 235, 236, 237, 245, 246

(56) References Cited

U.S. PATENT DOCUMENTS 4,506,409 A * 3/1985 Lautenschlager
4,716,622 A * 1/1988 DeBruyn
5,392,493 A * 2/1995 Youngdale
5,603,142 A * 2/1997 Dubach et al.
5,737,804 A * 4/1998 Ferrari et al.
5,826,305 A 10/1998 Domenig et al.
5,887,316 A 3/1999 Ferrari et al.
5,930,866 A * 8/1999 Rupprechter
6,125,508 A * 10/2000 Formenti

* cited by examiner

*Primary Examiner*—Anthony Knight
*Assistant Examiner*—Mark Williams
(74) *Attorney, Agent, or Firm*—John M. Harrington; Kilpatrick Stockton LLP

(57) ABSTRACT

A hinge for mounting a door on a furniture article frame includes a first hinge member adapted to be affixed to the furniture door and a first hinge arm segment pivoted to the first hinge member and having a first adjustment plate with an aperture and a second hinge member having a second hinge arm segment having a second adjustment plate with an aperture. Turning an adjustment screw connecting the adjustment plates to one another causes the second hinge arm segment to move relative to the first hinge arm segment in a direction perpendicular to the pivot axis and parallel to the door in a closed position thereof. A base plate adapted to be affixed to the furniture article frame by a fastening screw supports a movable plate formed on the second hinge member. Turning an eccentric mounted in the base plate causes the movable plate to be displaced on the base plate in a direction perpendicular to the pivot axis and perpendicular to the door in a closed position thereof.

14 Claims, 9 Drawing Sheets

ADJUSTABLE HINGE

Priority Application

This application is a continuation-in-part of co-pending U.S. patent application Ser. No. 09/434,087 filed Nov. 5, 1999, now U.S. Pat. No. 6,240,599 entitled "Adjustable Hinge."

RELATED APPLICATION

This application is related to co-pending U.S. Patent Application filed simultaneously herewith, entitled "Adjustable Hinge" and incorporated herein by this reference.

BACKGROUND OF THE INVENTION

1. Field of the Invention

The present invention relates to a hinge for mounting a door on a frame of a furniture article and more particularly to a hinge with an adjustable hinge arm which enables adjustment of the mounted door relative to the supporting frame.

2. Description of the Prior Art

Various types of hinges for mounting a door on a furniture article such as a desk or cabinet have been used in the furniture and cabinetry industry for many years. An example of one such device is known from U.S. Pat. No. 4,716,622. Many of such devices include multiple adjustment components making them bulky, difficult to adjust, quick to wear, and unstable. Typically, one or more screws must be loosened, an adjustment made manually, and then one or more screws must be re-tightened to secure the adjustment. Examples of such hinges include those described in U.S. Pat. Nos. 5,295,282, 5,392,493, and 5,511,287. Accordingly, many adjustable hinges may require more than one person to accomplish the adjustment.

To provide adjustable hinges that are operable with greater efficiency and more precise reliability, it has been determined that more refined design engineering skills are required, and the present invention addresses this need and interest.

SUMMARY OF THE INVENTION

The general purpose of the present invention, which will be described subsequently in greater detail, is to provide a new and improved hinge for mounting a door on a frame of a furniture article such as a cabinet or desk and with an adjustable hinge arm for adjusting the door relative to the supporting frame that has all of the advantages of prior art hinges and none of the disadvantages. The present invention provides a hinge which is microadjustable, or continuously adjustable in a precise manner, throughout the range of adjustment provided. Further, the present invention provides a hinge which enables stable microadjustments by actuating a single adjustment screw. The components of the hinge remain stably secured to each other, and to the door and the frame of the furniture article throughout the adjustment. Adjustment may be accomplished by a single person without the door becoming unsecured or unstable relative to the frame of the furniture article.

A representative embodiment of the present invention is illustrated in the drawings. The hinge of the present invention makes use of a first hinge member in the form of a cup mountable flush in a bore hole with fastening screws in a known way in the back of a door and a second hinge member adapted to be affixed to a frame. The second hinge member includes a substantially flat portion with an opening in the form of a closed-end or open-end slot through which a fastening screw can be driven into the frame, likewise in a known way.

Herein, the terms "rearward" and "forward," unless otherwise noted, are independently determined for each hinge arm segment. For each hinge arm segment the more rearward portion is that which is proximal to its connection to either a door or frame. The more forward portion of each hinge arm is that portion which is distal to its connection to either a door or frame. Accordingly, the adjustable hinge of the invention relates to two hinge arm segments which are adjustably connected at their forward ends to one another.

Accordingly in one aspect, the present invention relates to a hinge for mounting a door on a frame of a furniture article, comprising a first hinge member adapted to be affixed to the furniture door; a first hinge arm segment having a rearward end portion pivoted to the first hinge member on a pivot axis and having a forward end portion on which is formed a first adjustment plate comprising two segments, the more forward segment forming a right angle with the more rearward segment and comprising an aperture; a second hinge member adapted to be fastened to the furniture article frame; a second hinge arm segment having a rearward end portion extending from the second hinge member, the second hinge member and second hinge arm segment being formed as one piece, and the second hinge arm segment having a forward end portion on which is formed a second adjustment plate comprising two segments, the more rearward segment comprising an aperture and forming a right angle with the more forward segment; wherein the first and second hinge arm segments being adjustably connected to one another by a screw cooperating with the adjustment plates through one of the apertures which is threaded and one aperture which is unthreaded.

In a preferred embodiment, the adjustment screw of the invention further comprises an unthreaded portion proximal to a head of the adjustment screw, and the unthreaded portion engages one of the adjustment plate apertures which is unthreaded.

In another preferred embodiment, at least one of the first and second adjustment plates further comprises opposing lateral edges from which depend a pair of opposing side members which define a channel for receiving the other adjustment plate. More preferably, the opposing lateral edges are spaced from one another a distance which defines a width of the adjustment plate. Most preferably, the opposing side members are spaced from one another a distance which is at least as great as the width of the other adjustment plate.

In another preferred embodiment, longitudinal movement of the adjustment screw is restricted relative to the adjustment plates comprising the unthreaded aperture by a retaining pin perpendicular to the adjustment screw which contacts an annular groove circumscribing the adjustment screw. More preferably, the retaining pin is secured by end portions inserted in opposing apertures formed in the opposing side members of the adjustment plate which comprises the unthreaded aperture.

In another preferred embodiment, the adjustment plate which is received in the channel also comprises opposing lateral edges and a pair of opposing side members depending therefrom. More preferably, these opposing side members contact the retaining pin along edges of the opposing side members which are perpendicular to the retaining pin.

In another preferred embodiment, the adjustment plate comprising the threaded aperture further comprises a raised portion which contacts and stabilizes the adjustment screw on the side of the adjustment screw opposite its contact with the retaining pin. More preferably, the raised portion further comprises lateral flange members which contact opposing sides of the adjustment screw, perpendicular to the opposing sides of the adjustment screw contacted by the retaining pin and the raised portion. Most preferably, the adjustment screw further comprises an unthreaded portion distal to a head portion of the adjustment screw, and the unthreaded portion contacts the raised portion of the adjustment plate.

A three-way adjustment aspect of an embodiment of the adjustable hinge of the present invention not only allows adjustment of the position of a cabinet door vertically up and down relative to the supporting cabinet (e.g., up and down with the door in the closed position to achieve desired spacing of the door from the top and bottom of the cabinet door opening) and horizontally from side to side relative to the supporting cabinet (e.g., from side to side with the door in the closed position to achieve desired spacing of the door from the opposite sides of the cabinet door opening), but also enables adjustment of the cabinet door horizontally in and out relative to the supporting cabinet (e.g., to and fro with the door in the closed position to achieve desired alignment of the front face of the door with the front of the cabinet).

In the three-way adjustment aspect of the hinge for an embodiment of the present invention, a hinge for mounting a door on a furniture article frame for movement between open and closed positions of the door relative to the furniture article frame includes, for example, a first hinge member adapted to be affixed to the door. A first hinge arm segment is pivoted to the first hinge member on a pivot axis defined by a hinge pin and has a forward end portion on which is formed a first adjustment plate with a forward segment and a rearward segment. The forward segment has an aperture and forms a right angle with the rearward segment. A second hinge arm segment has a second adjustment plate formed thereon with a forward segment and a rearward segment. The rearward segment has an aperture and forms a right angle with the forward segment. An adjustment screw cooperates with the adjustment plates through one of the apertures which is threaded and one aperture which is unthreaded to adjustably connect the first and second hinge arm segments to one another. Turning the adjustment screw causes the second hinge arm segment to move relative to the first hinge arm segment in a direction perpendicular to the pivot axis and parallel to the door in a closed position thereof.

In this aspect, at least one of said first and second adjustment plates has opposing lateral edges and a pair of opposing side members depending therefrom to define a channel for receiving the other adjustment plate. In addition, a retaining pin extends perpendicular to the adjustment screw and contacts an annular groove circumscribing the adjustment screw. The adjustment screw has an unthreaded portion distal to a head of the adjustment screw which contacts a raised portion of one of the adjustment plates. The second adjustment plate has a pair of opposing side members that define a channel receiving the first adjustment plate. The aperture of the first adjustment plate is threaded, and the aperture of the second adjustment plate is unthreaded, and the adjustment screw has a threaded shaft portion which is received in the threaded aperture. Longitudinal movement of the adjustment screw is restricted relative to the second adjustment plate by the retaining pin extending perpendicular to the adjustment screw and contacting the annular groove circumscribing the adjustment screw. The retaining pin is secured by end portions inserted in opposing apertures formed in opposing side members of the second adjustment plate. The adjustment screw also has an unthreaded portion proximal to the head of the adjustment screw that engages the unthreaded aperture of the second adjustment plate.

The hinge for the three-way adjustment aspect of an embodiment of the present invention also includes, for example, a base plate having an aperture that is elongated and extends parallel to the pivot axis. The base plate is adapted to be fastened on the furniture article frame by at least one mounting screw inserted through the aperture. The elongated aperture allows the base plate to be displaced related to the furniture article frame in a direction parallel to the pivot axis and parallel to the door in a closed position thereof by loosening the mounting screw. The base plate has opposing lateral edges, each of which edges is bent to form a somewhat Z-shaped cross section with a web part and a flange part. A movable plate is formed on the rearward end portion of the second hinge arm segment and has opposing lateral edges, each of which edges is bent and on each of which bent edges are formed front and rear retaining members. The bent edges and the front and rear retaining members of the movable plate define a pair of opposing channels that receive the flange parts of the base plate and hold the movable plate and base plate together.

In the three-way adjustment feature for an embodiment of the present invention, an eccentric mounted in the base plate by means of a dowel extends through an elongated opening in the movable plate which extends parallel to the pivot axis. The movable plate also has an aperture formed therein which is somewhat rectangular and larger than the aperture of the base plate. The eccentric is rotatable about a central axis thereof, and the dowel extends parallel to the central axis of the eccentric and is radially offset therefrom. Turning the eccentric causes the movable plate to be displaced on the base plate in a direction perpendicular to the pivot axis and perpendicular to the door in a closed position thereof.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be further understood that the phraseology and terminology employed herein are for the purpose of description and are not to be regarded as limiting. Those skilled in the art will appreciate that the conception on which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved hinge for mounting a door on a frame of a furniture article such as a desk or cabinet which has all of the advantages, and more, of prior art devices and none of the disadvantages.

It is another object of the present invention to provide a new and improved hinge for mounting a door on a frame of a furniture article that is more reliable and functional than those presently available.

Yet another object of the present invention is to provide a new and sophisticated, precision made adjustable hinge that is compact, can operate reliably and efficiently, and yet enable renewed, limited adjustments to be made to the mounted door with respect to the frame of the furniture article.

It is an additional feature and advantage of the present invention to provide an adjustable hinge with a three-way adjustment aspect, which enables adjustment of the cabinet door horizontally in and out relative to the supporting cabinet (e.g., to and fro with the door in the closed position to achieve desired alignment of the front face of the door with the front of the cabinet) in addition to up and down and side to side adjustment of the door.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

This invention will be better understood and objects other than those set forth above, will become apparent when consideration is given to the following detailed description. Such description makes reference to the annexed drawings wherein.

DETAILED DESCRIPTION OF THE INVENTION

Figure 1:
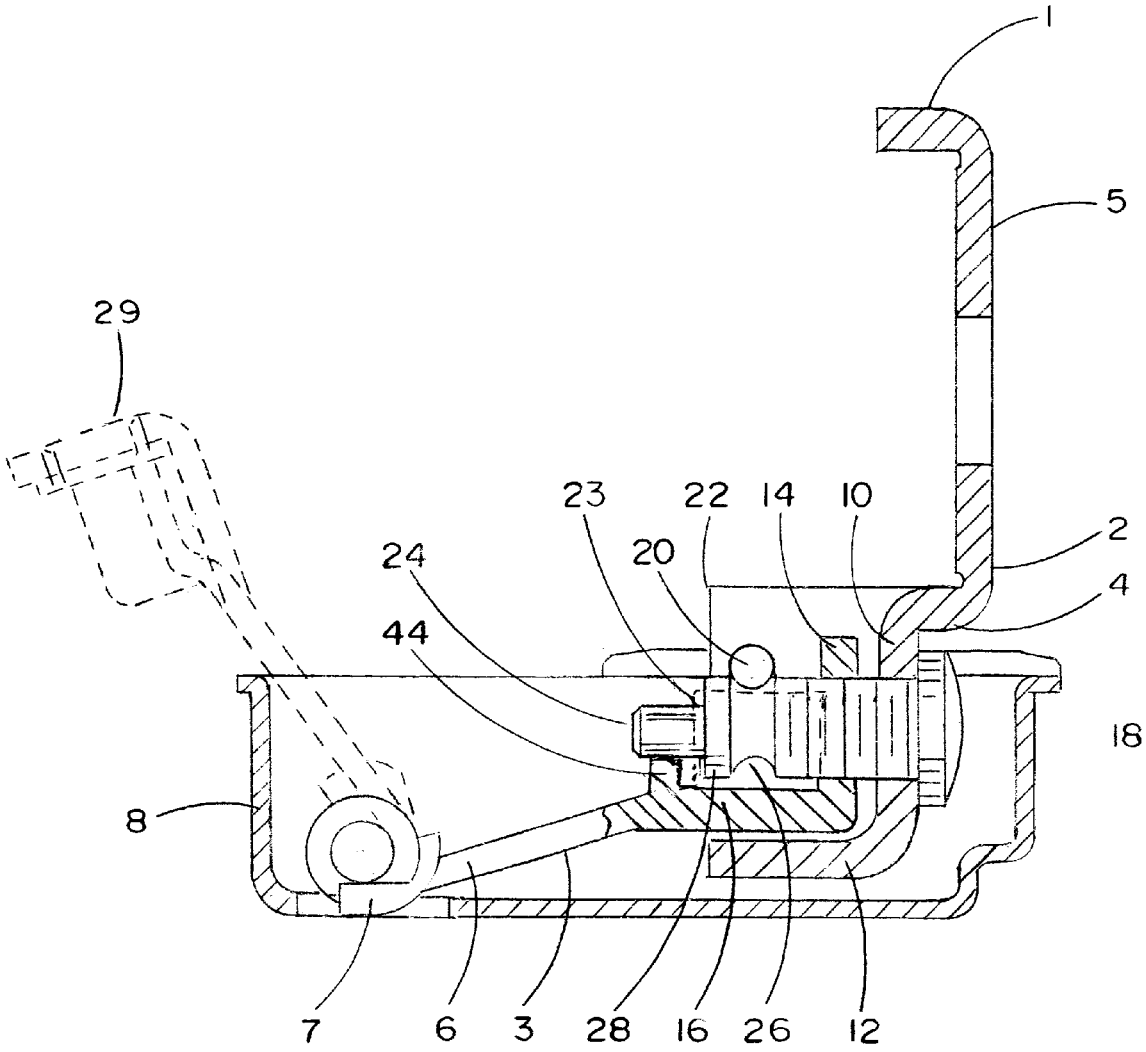
FIG. 1 is a side cross-section view of a hinge of the present invention, with the hinge in the closed position.

In the description which follows, the terms "rearward" and "forward," unless otherwise noted, are independently determined for each hinge arm segment. For each hinge arm segment the more rearward portion is that which is proximal to its connection to either a door or frame. The more forward portion of each hinge arm is that portion which is distal to its connection to either a door or frame. Accordingly, the adjustable hinge of the invention relates to two hinge arm segments which are adjustably connected at their forward ends to one another.

Accordingly, in one aspect, the present invention relates to a hinge for mounting a door on a furniture article frame, comprising a first hinge member adapted to be affixed to the furniture door; a first hinge arm segment having a rearward end portion pivoted to the first hinge member on a pivot axis and having a forward end portion on which is formed a first adjustment plate comprising two segments, the more forward segment forming a right angle with the more rearward segment and comprising an aperture; a second hinge member adapted to be fastened to the furniture article frame; a second hinge arm segment having a rearward end portion extending from the second hinge member, the second hinge member and second hinge arm segment being formed as one piece, and the second hinge arm segment having a forward end portion on which is formed a second adjustment plate comprising two segments, the more rearward segment comprising an aperture and forming a right angle with the more forward segment; wherein the first and second hinge arm segments are adjustably connected to one another by an adjustment screw cooperating with the adjustment plates through one of the apertures which is threaded and one aperture which is unthreaded.

In a preferred embodiment, the adjustment screw of the invention further comprises an unthreaded portion proximal to a head of the adjustment screw, and the unthreaded portion engages one of the adjustment plate apertures which is unthreaded.

In another preferred embodiment, at least one of the first and second adjustment plates further comprises opposing lateral edges from which depend a pair of opposing side members which define a channel for receiving the other adjustment plate. More preferably, the opposing lateral edges are spaced from one another a distance which defines a width of the adjustment plate. Most preferably, the opposing side members are spaced from one another a distance which is at least as great as the width of the other adjustment plate.

In another preferred embodiment, longitudinal movement of the adjustment screw is restricted relative to the adjustment plates comprising the unthreaded aperture by a retaining pin perpendicular to the adjustment screw which contacts an annular groove circumscribing the adjustment screw. More preferably, the retaining pin is secured by end portions inserted in opposing apertures formed in the opposing side members of the adjustment plate which comprises the unthreaded aperture.

In another preferred embodiment, the adjustment plate which is received in the channel also comprises opposing lateral edges and a pair of opposing side members depending therefrom. More preferably, these opposing side members contact the retaining pin along edges of the opposing side members which are perpendicular to the retaining pin.

In another preferred embodiment, the adjustment plate comprising the threaded aperture further comprises a raised portion which contacts and stabilizes the adjustment screw on the side of the adjustment screw opposite its contact with the retaining pin. More preferably, the raised portion further comprises lateral flange members which contact opposing sides of the adjustment screw, perpendicular to the opposing sides of the adjustment screw contacted by the retaining pin and the raised portion. Most preferably, the adjustment screw further comprises an unthreaded portion distal to a head portion of the adjustment screw, and the unthreaded portion contacts the raised portion of the adjustment plate.

In another preferred embodiment, the opposing lateral edges of the second adjustment plate comprise a pair of opposing side members which define a channel for receiving the first adjustment plate. More preferably, the pair of opposing side members are spaced apart from one another a distance which is at least as great as the width of the first adjustment plate.

In another preferred embodiment, the aperture of the first adjustment plate is threaded and the aperture of the second adjustment plate is unthreaded, and a threaded shaft portion the adjustment screw is received in the threaded aperture of the first adjustment plate.

In another preferred embodiment, longitudinal movement of the adjustment screw is restricted relative to the second adjustment plate by a retaining pin perpendicular to the adjustment screw which contacts an annular groove circumscribing said adjustment screw, wherein said retaining pin is secured by end portions inserted in opposing apertures formed in said opposing side members of said second adjustment plate.

In another preferred embodiment, the first adjustment plate also comprises a pair of opposing side members depending from its opposing lateral edges. More preferably, the opposing side members comprise edge portions distal their connection to the rearward segment of the first adjustment plate and perpendicular to the retaining pin. Most preferably, the edge portions contact the retaining pin to stabilize the connection between the first and second hinge arm segments.

In another preferred embodiment, the adjustment screw comprises an unthreaded portion proximal to a head of the adjustment screw, and this unthreaded portion engages the unthreaded aperture of the second adjustment plate.

In another preferred embodiment, the rearward segment of the first adjustment plate further comprises a raised portion which contacts and stabilizes the adjustment screw on the side of the adjustment screw opposite from its contact with the retaining pin. More preferably, the raised portion also comprises lateral flange members which contact opposing sides of the adjustment screw perpendicular to the sides of the adjustment screw contacted by the retaining pin and the raised portion of the adjustment plate. Most preferably, the adjustment screw further comprises an unthreaded portion distal to a head of the adjustment screw, and the unthreaded portion contacts the raised portion of the adjustment plate.

Referring now to the drawings, and particularly to FIG. 1, the hinge of the present invention, shown generally as 1 in FIG. 1, serves to hang a door on a frame of a furniture article, such as a cabinet. A frame defines a door opening (not shown) on which door is closed in the position of hinge 1 shown in FIG. 1 (and open in the position of the first hinge arm 3, shown in outline 30 in FIG. 1). Hinge 1 includes a first hinge member 8 in the form of a cup mountable flush in a bore hole with fastening screws in a known manner, in the back of a door, and a second hinge arm 2 adapted to be affixed to a door frame. Second hinge arm 2 includes a substantially flat portion or second hinge member 5 with one or more openings for receiving one or more fastening screws which can be driven into a door frame, likewise in a known way.

Hinge 1 makes use of a first hinge arm 3 having a rearward end portion 7 pivoted to first hinge member 8 on a pivot axis, such as a hinge pin fastened in first hinge member 8. First hinge arm segment 6 connects rearward end portion 7 of first hinge arm 3 to a forward end portion on which is formed a first adjustment plate comprising a more rearward segment 16 and a more forward segment 14, which are joined at an common edge to form a substantially right angle. In other words, first hinge arm 3, with its rearward end portion 7, first hinge arm segment 6 and rearward and forward first adjustment plate segments 16, 14, is formed as one piece.

Hinge 1 also makes use of a second hinge arm 2 having a rearward end portion comprising second hinge member 5. Second hinge arm segment 4 connects second hinge member 5 with a forward end portion on which is formed a second adjustment plate comprising a more rearward segment 10 and a more forward segment 12, which are joined at an common edge to form a substantially right angle. Second hinge arm 2, with its second hinge member 5, second hinge arm segment 4, and rearward and forward 5 second adjustment plate segments 10, 12, is formed together as one piece.

Figure 2:
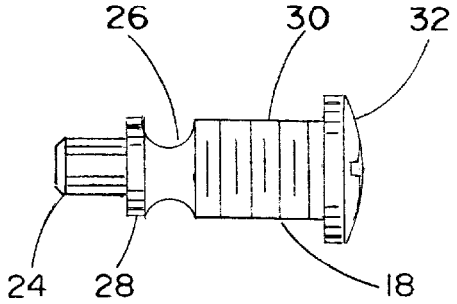
FIG. 2 is a side view of the adjustment screw.
Figure 3:
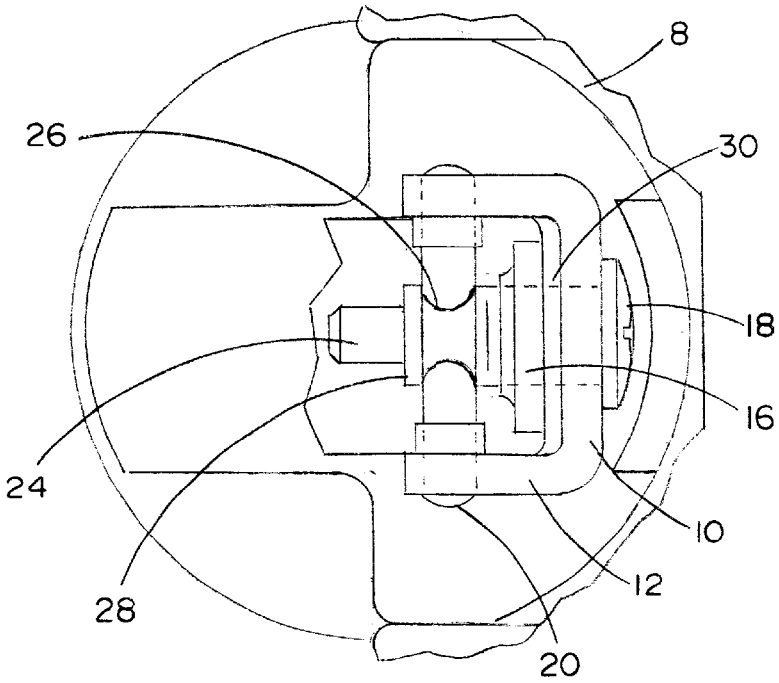
FIG. 3 is a bottom cut-away, cross sectional view of the hinge of FIG. 1 (closed position) showing the adjustment plates of the first and second hinge arm with adjustment screw.

First and second hinge arm segments 4, 6 are connected to one another by screw means, such as headed screw 18, as shown in FIGS. 1–3, cooperating with the first and second adjustment plates. When so connected to one another, first and second hinge arm segments 4, 6 form a complete hinge arm with rearward end portion 7 of first hinge arm segment 6 pivoted to first hinge member 8 and rearward end portion of second hinge arm segment 4 extending from and formed as one piece with second hinge member 5.

Figure 4:
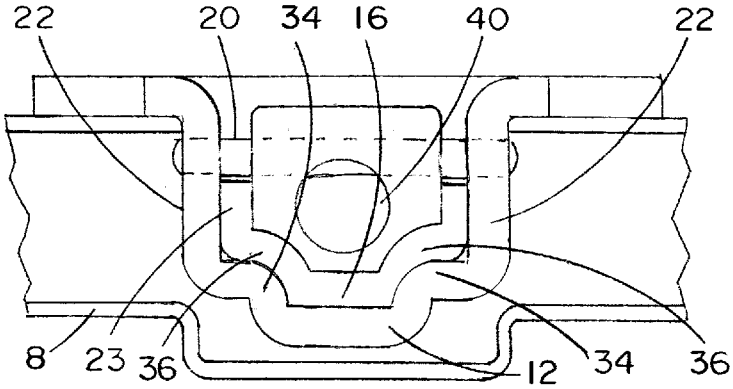
FIG. 4 is a cross sectional, end view showing the adjustment plates of the first and second hinge arm of the hinge of FIG. 1 (closed position).

Referring now to FIG. 2, adjustment screw 18 is shown in a longitudinal side view. Head 32 is shown as connected to threaded portion 30. The threaded portion 30 is adjacent to a circumferential groove 26 (in which contacts retaining pin 20 as shown in FIGS. 1, 3, and 4). Adjustment screw 18 may also comprise an unthreaded collar portion 28, which is connected to an extended unthreaded portion of reduced diameter 24. In other embodiments, adjustment screw 18 may be a simple threaded screw of uniform diameter.

FIG. 3 shows a cross-sectional bottom view of the first and second hinge plate engagement, through a cut-away view of the first hinge member 8. The engagement of retaining pin 20 with groove 26 of adjustment screw 18 is shown, as well as the cooperation of adjustment plate segments 16 and 14 with adjustment screw 18 via threaded aperture 40 and unthreaded aperture 54, respectively (see aperture 40 in FIG. 4 and aperture 54 in FIG. 10).

Each of the rearward and forward segments of the first and second adjustment plates has a generally planar rectangular shape with opposing parallel lateral edges, which opposing edges are each spaced from one another by a distance which defines a respective width of first and second adjustment plates. The second adjustment plate includes positioning means for aligning first and second adjustment plates on one another in the form of a pair of opposing parallel side members 22 depending from opposing lateral edges of second adjustment plate segments 10, 12 to define a channel for receiving the first adjustment plate.

Figure 5:
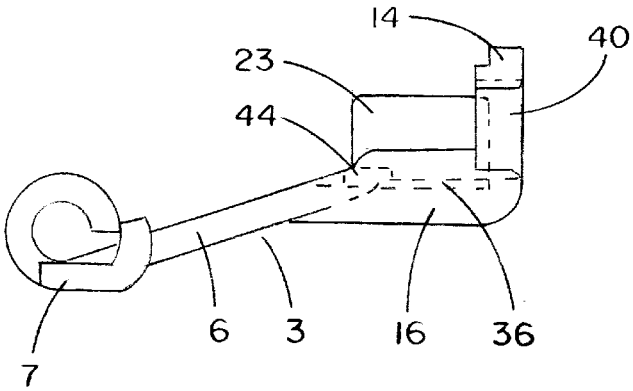
FIG. 5 is a side view of the first hinge arm of the hinge of FIG. 1.

The opposing parallel side members 22 of the second adjustment plate are shown in FIG. 1 and also in the cross-sectional end view of FIG. 4. FIG. 4 also shows similar opposing side members 23 of the first adjustment plate which are also shown in FIGS. 1 and 5, in side view. The opposing side members 23 of the first adjustment plate contact retaining pin 20, such that the connection between the first hinge arm and the second hinge arm is stabilized. FIG. 4 further shows the complementary curved areas 34 and 36, of the rearward segment 16 of the first adjustment plate and the forward segment 12 of the second adjustment plate, respectively. These curved areas 34, 36 of the first and second adjustment plates strengthen the adjustment plates and complement the structure of one embodiment of the first hinge member 8.

Figure 6:
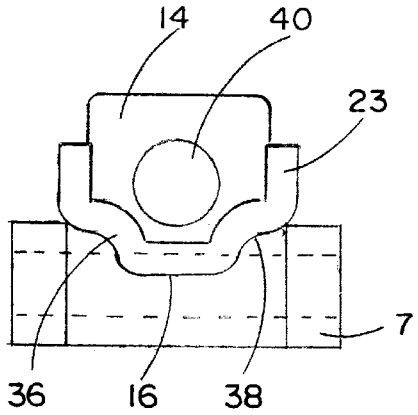
FIG. 6 is an end view of the first hinge arm, as from the right of the view of FIG. 5.
Figure 8:
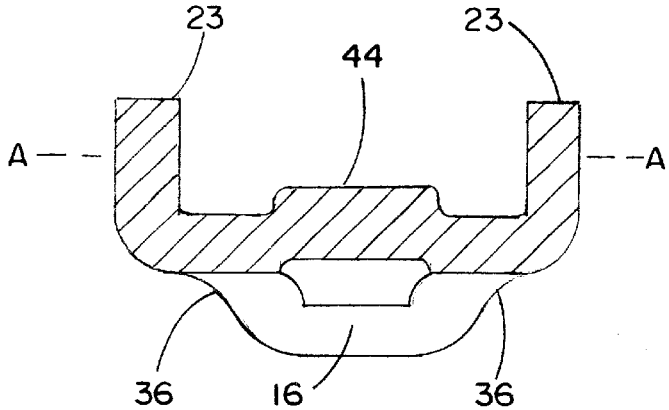
FIG. 8 is a cross sectional view of the first hinge arm, "A—A" as indicated in FIG. 6.
Figure 7:
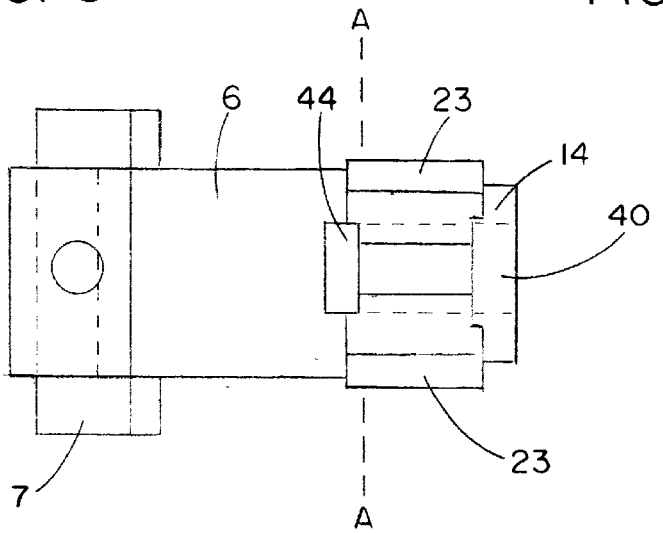
FIG. 7 is a top view of the first hinge arm, as shown in FIG. 5.

FIG. 5 shows side view first hinge arm 3 showing, in particular, one of the opposing side members 23 (opposite side member 23 not shown), and aperture 40 in forward segment 14. FIG. 6 shows a end view (from forward end) of first hinge arm 3. FIG. 7 is a top view relative to the view of FIG. 5, and shows raised portion 44, shown also in FIGS. 1 and 8, and in outline in FIG. 5. Raised portion 44 contacts adjustment screw 18 on unthreaded portion 24, on the opposite side of adjustment screw 18 from retaining pin 20, in order to provide further stability to the adjustment screw 18. The raised portion 44 may additionally comprise a pair of opposing flanges (not shown) which further contact the adjustment screw 18 on opposing sides, perpendicular to opposing sides of the adjustment screw contacted by the retaining pin 20 and the raised portion 44.

Accordingly, opposing side members 22 of second adjustment plate are spaced from one another by a distance which is at least as great as, or preferably slightly greater than, the width of first adjustment plate. The first adjustment plate is received in the channel formed between opposing side members 22 of the second adjustment plate with the first and second adjustment plates generally parallel to one another and with side members 23 of the opposing lateral edges of first adjustment plate adjacent generally parallel to side members 22 of the second adjustment plate. When retaining pin 20 is inserted through corresponding apertures in opposing side members 22 of the second adjustment plate, the edges of the opposing side members 23 of the first adjustment plate abut retaining pin 20. When so engaged, first and second adjustment plates are aligned with one another and remain aligned with one another so long as first and second hinge arms 2, 3 remain connected to one another.

Figure 9:
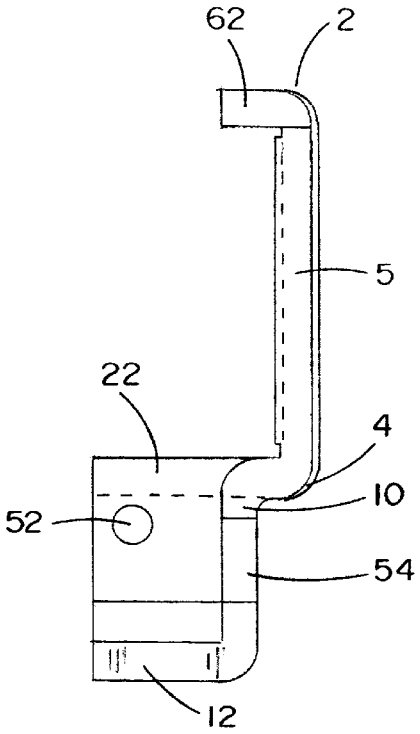
FIG. 9 is a side view of the second hinge arm of the hinge of FIG. 1.
Figure 10:
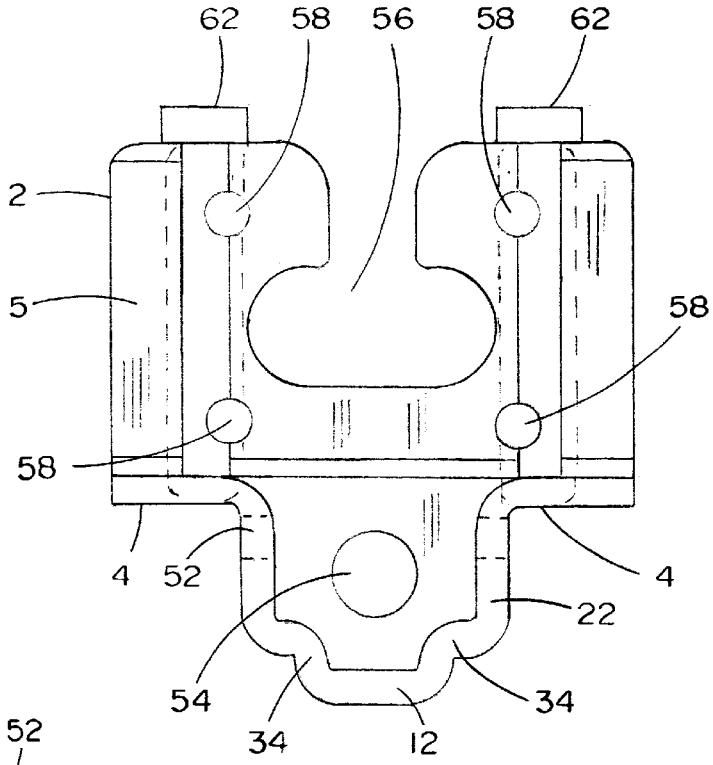
FIG. 10 is a view of the second hinge arm, as from the right of the view of FIG. 9.
Figure 11:
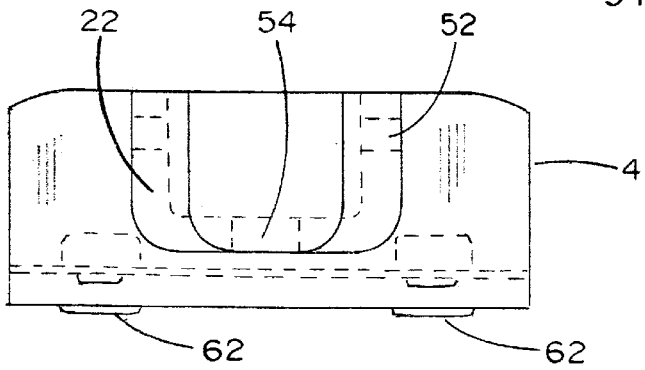
FIG. 11 is a view of the second hinge arm, as from the bottom of the view of FIG. 9.
Figure 12:
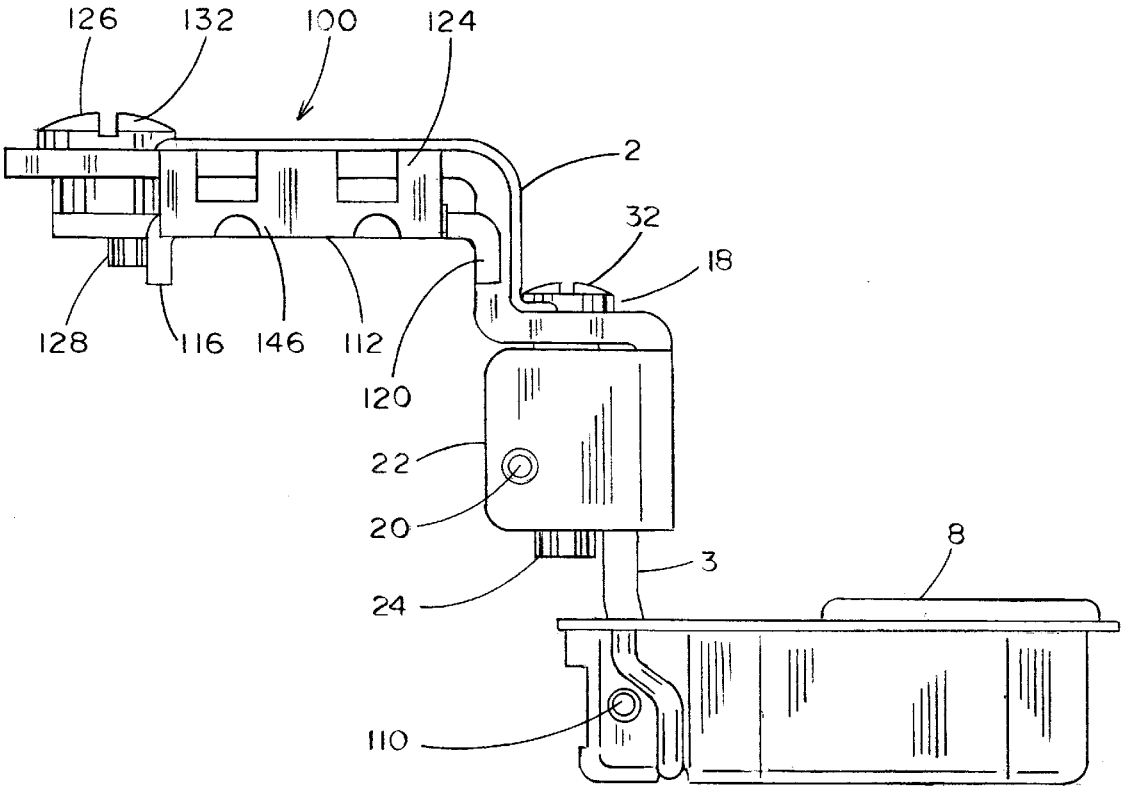
FIGS. 12–14 illustrate an example of an adjustable hinge with a three-way adjustment feature for an embodiment of the present invention.
Figure 13:
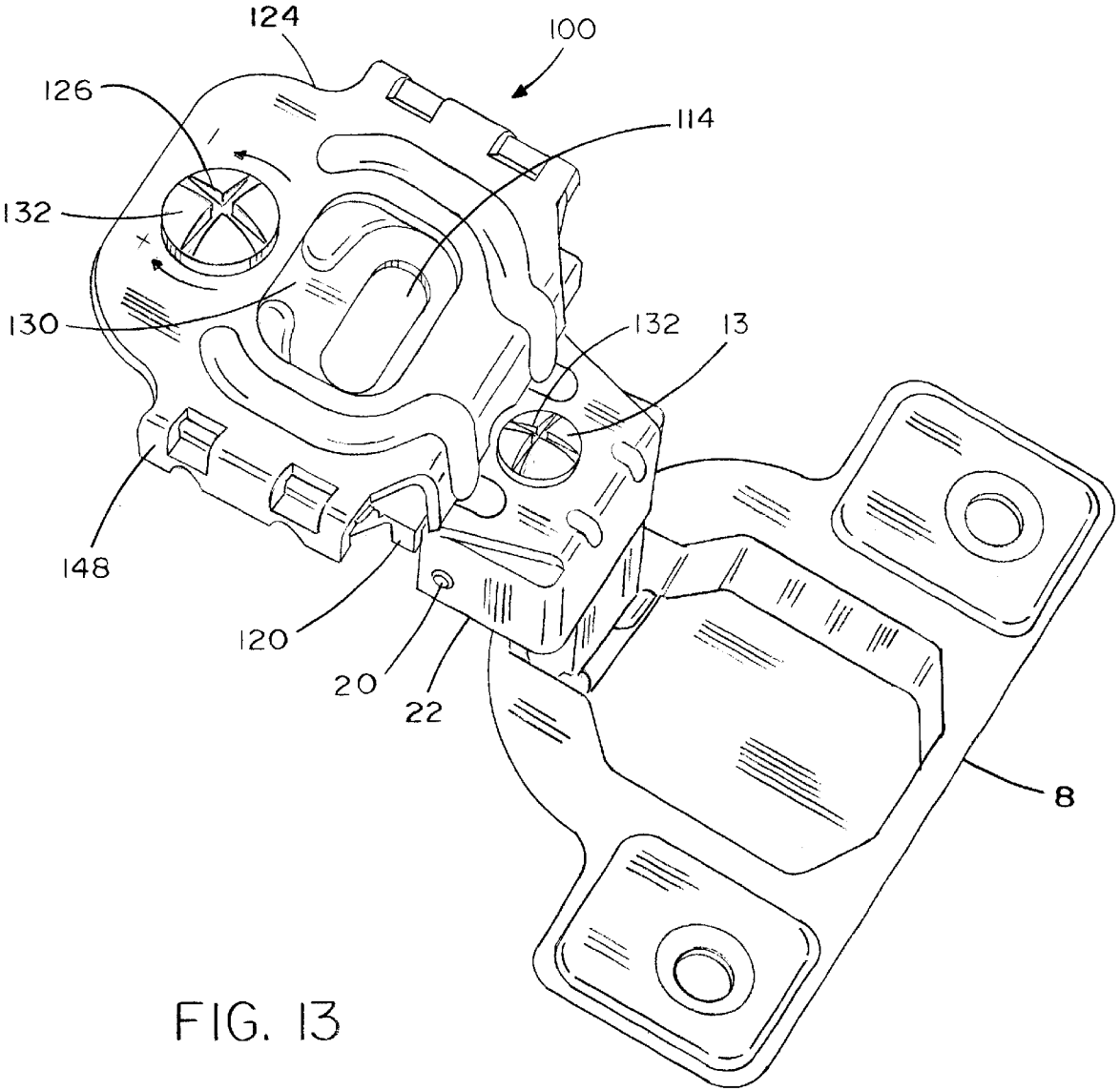
Figure 14:
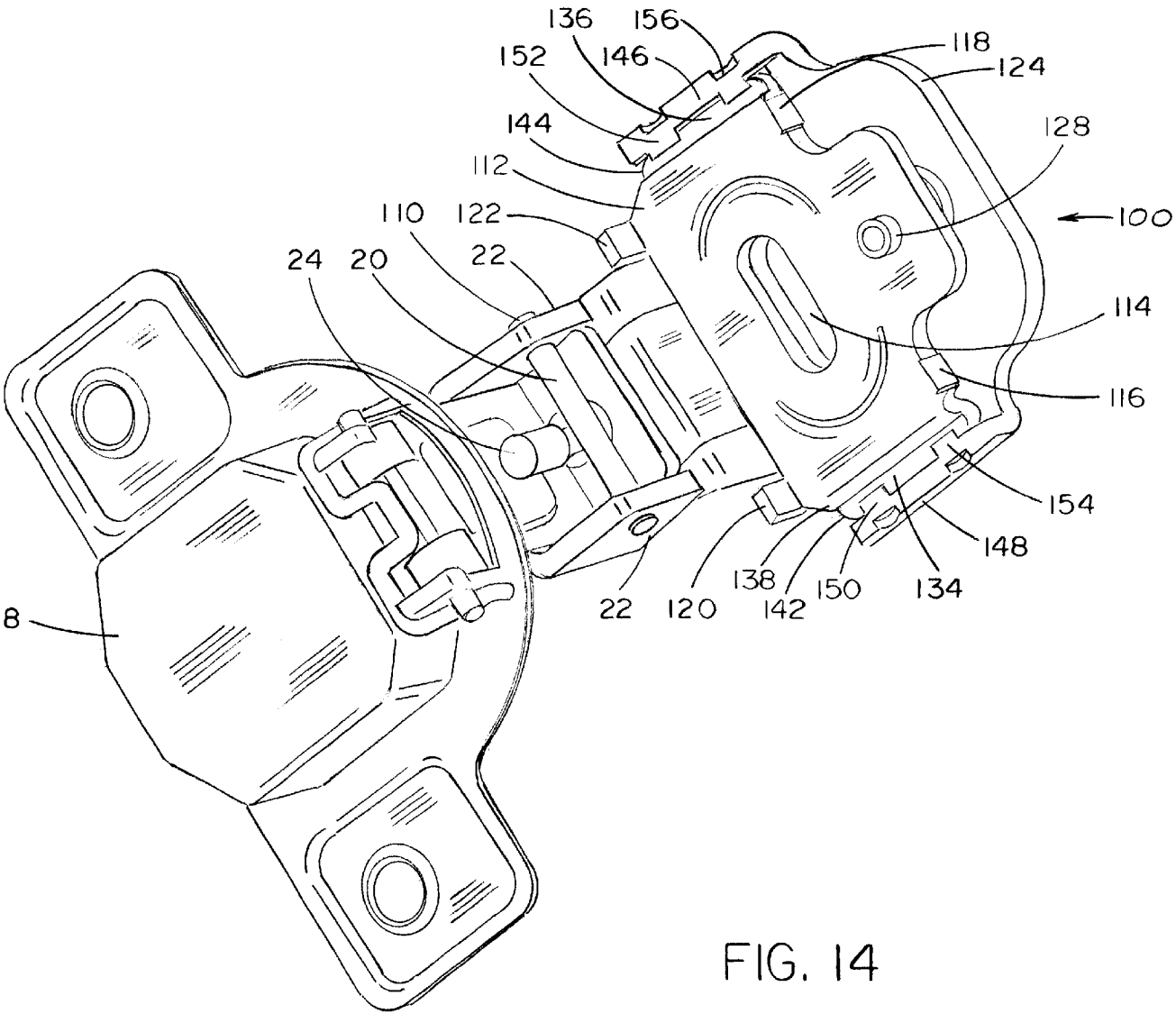
Figure 15:
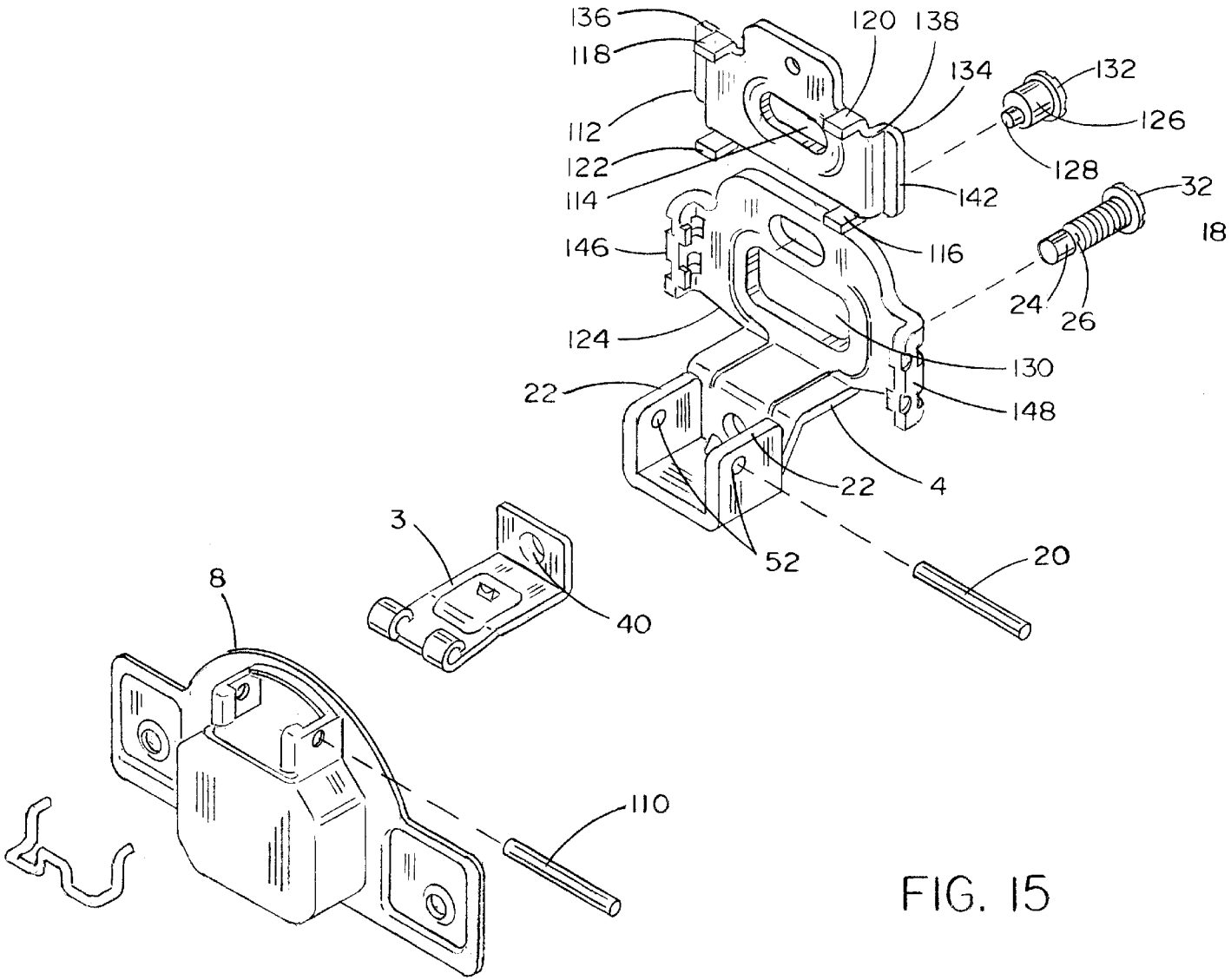
FIGS. 15 and 16 show an exploded view of the adjustable hinge with the three-way adjustment feature for an embodiment of the present invention.
Figure 16:
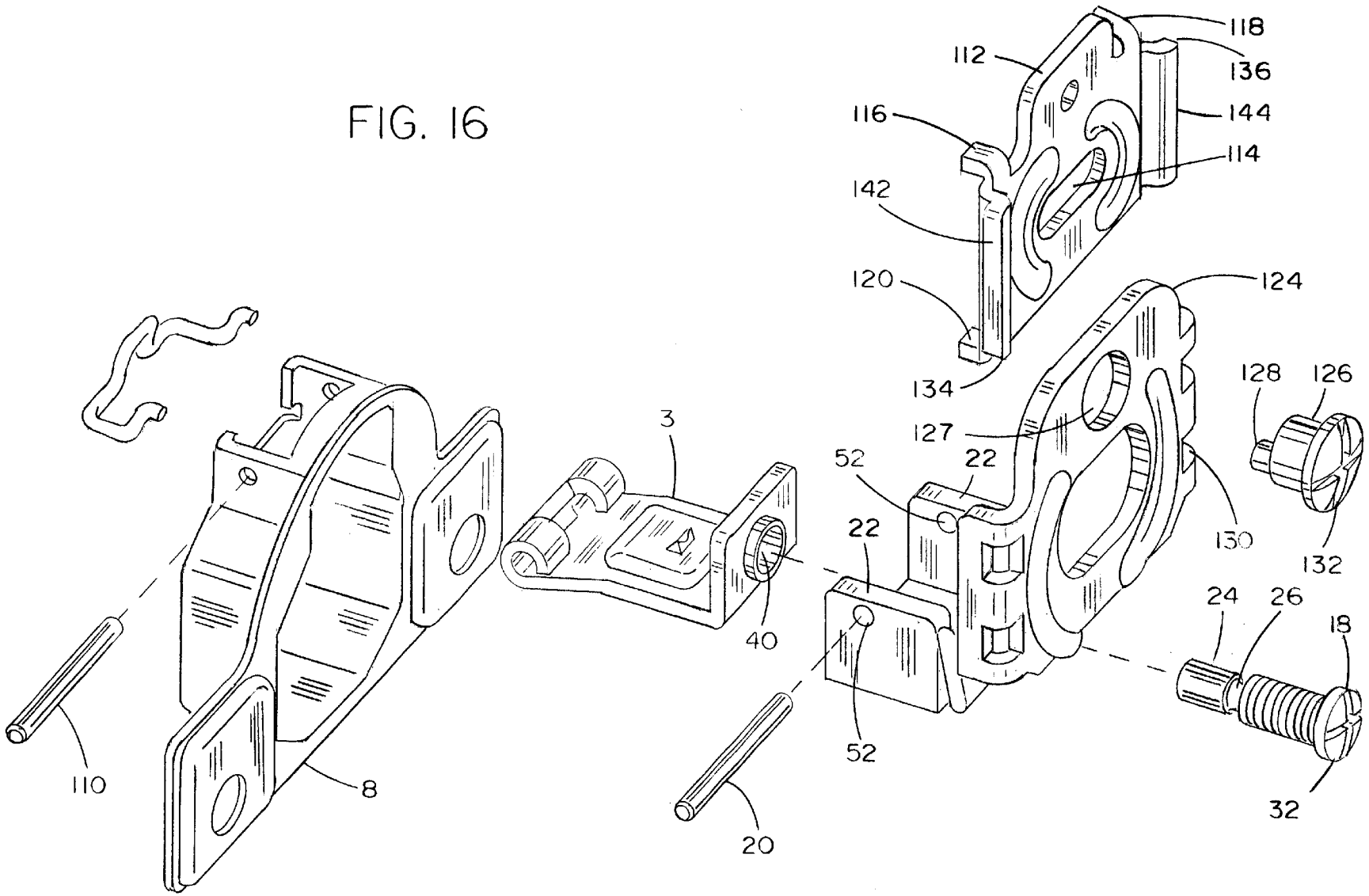

FIG. 9 is a side view of the second hinge arm 2, showing rearward portion of second hinge arm 2 with flange portions 62 depending a substantially right angles from second hinge member 5, which connected by second hinge arm segment 4 to the rearward adjustment plate segment 10, which comprises unthreaded aperture 54. Rearward adjustment plate segment 10 is joined along a forward edge to the rearward edge of forward adjustment plate segment 12, forming a substantially right angle. One of opposing side members 22 is also shown, with retaining pin aperture 52 which holds retaining pin 20. FIG. 10 shows in particular, the features of one embodiment of second hinge member 5, including fastener opening 56 which may be open to the edge of second hinge member 5 as shown, as well as additional fastener apertures 58. Opening 56 may also be a closed aperture. FIG. 11 shows an end view of hinge arm 2, as viewed from the bottom of the view shown in FIG. 9.

The adjustment means cooperating with adjustment screw 18, enabling limited adjustment of first and second adjustment plates in relation to one another, includes an unthreaded aperture 54 formed in the rearward segment 10 of the second adjustment plate, through which screw 18 extends, and also threaded aperture 40 in forward segment 14 of the first adjustment plate, as shown in FIGS. 4–7, to permit adjustment of first and second adjustment plates in relation to one another.

A three-way adjustment aspect of an embodiment of the adjustable hinge of the present invention not only allows adjustment of the position of a cabinet door vertically up and down relative to the supporting cabinet (e.g., up and down with the door in the closed position to achieve desired spacing of the door from the top and bottom of the cabinet door opening) and horizontally from side to side relative to the supporting cabinet (e.g., from side to side with the door in the closed position to achieve desired spacing of the door from the opposite sides of the cabinet door opening), but also enables adjustment of the cabinet door horizontally in and out relative to the supporting cabinet (e.g., to and fro with the door in the closed position to achieve desired alignment of the front face of the door with the front of the cabinet). FIGS. 12–16 illustrate an example of the adjustable hinge with the three-way adjustment feature for an embodiment of the resent invention. The adjustable hinge component, shown generally as 100 on FIGS. 12–14, of the adjustable hinge for an embodiment of the present invention is mounted, for example, on a face frame of the cabinet (not shown) and supports a cabinet door (not shown) with hinge member 8 mounted on the door. Adjustable hinge component 100 is pivotally connected to hinge member 8, via hinge arm part 3, on a hinge pin 110.

The adjustable hinge component 100 of the hinge for an embodiment of the present invention includes a base plate 112 that is mounted directly on the supporting cabinet via a fastening screw (not shown). The fastening screw is inserted through an elongated opening 114 of the base plate 112 and screwed directly into an edge of a face frame of the supporting cabinet, such that the base plate lies in a plane perpendicular to a plane of the cabinet door when the cabinet door is in closed position relative to the cabinet. The position of the base plate 112, and thus the cabinet door supported by the hinge, can be adjusted vertically up and down relative to the cabinet over the length of the elongated opening 114 of the base plate 112. The base plate 112 has a pair of back legs 116, 118 that rest against a back side of the face frame and a pair of front legs 120, 122 that rest against a front side of the face frame in the mounted condition of the base plate 112.

In a mounted condition of the base plate 112 of the hinge component 100 for an embodiment of the present invention, the base plate 112 bears a movable plate 124 which is connected to and extends perpendicular to hinge arm 2. Mounted in the base plate 112 is an eccentric 126 which is riveted in the base plate 112 by means of a dowel 128. The eccentric 126 extends through an elongated aperture 127 in the movable plate 124 and has a head 132. The movable plate 124 also has an enlarged somewhat rectangular opening 130 for access to the mounting screw in elongated opening 114 of base plate 112, which is larger than elongated opening 114. Turning the eccentric 126 causes the movable plate 124 to be displaced on the base plate 112 horizontally in and out in a closed position of the cabinet door. The base plate 112 has opposing lateral edges 134, 136, each of which is bent upward to form a somewhat Z-shaped cross section with a web part 138, 140 perpendicular to the base plate 112 and a flange part 142, 144 parallel to the base plate 112.

In an embodiment of the present invention, the flange parts 142, 144 of the base plate 112 support the movable plate 124, and the movable plate 124 has opposing lateral edges 146, 148, each of which is bent downward perpendicular to the movable plate and on each of which is formed front and rear retaining members 150, 152 and 154, 156. The bent edges 146, 148 of the movable plate 124, together with the front and rear retaining members 150, 152 and 154, 156 of the movable plate 124 define a pair of opposing channels that receive the flange parts 142, 144 of the base plate 112 and hold the movable plate 124 and base plate 112 together, while allowing the movable plate 124 to move forward and rearward relative to the base plate 112 when the eccentric 126 is turned. As mentioned, turning the eccentric 126 causes the movable plate 124 to be displaced on the base plate 112 horizontally in and out, and thus causes the cabinet door to be moved to and fro within the cabinet door opening in a closed position of the cabinet door.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principal of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hinge for mounting a door on a furniture article frame for movement between open and closed positions of the door relative to the furniture article frame, comprising:

a first hinge member adapted to be affixed to the door;

a first hinge arm segment pivoted to the first hinge member on a pivot axis and having a forward end portion on which is formed a first adjustment plate with a forward segment and a rearward segment, the forward segment having an aperture and forming a right angle with the rearward segment;

a second hinge arm segment on which is formed a second adjustment plate with a forward segment and a rearward segment, the rearward segment having an aperture and forming a right angle with the forward segment;

an adjustment screw cooperating with the adjustment plates through one of the apertures which is threaded and one aperture which is unthreaded to adjustably connect the first and second hinge arm segments to one another, wherein turning the adjustment screw causes the second hinge arm segment to move relative to the first hinge arm segment in a direction perpendicular to the pivot axis and parallel to the door in a closed position thereof;

a base plate having an aperture and adapted to be fastened on the furniture article frame by at least one mounting screw inserted through the aperture, said base plate having opposing lateral edges, each of which edges is bent to form a web part and a flange part;

a movable plate formed on the rearward end portion of the second hinge arm segment having opposing lateral edges, each of which edges is bent and on each of which bent edges are formed front and rear retaining members, the bent edges and the front and rear retaining members of the movable plate defining a pair of opposing channels that receive the flange parts of the base plate and hold the movable plate and base plate together; and an eccentric mounted in the base plate by means of a dowel, the eccentric extending through an elongated opening in the movable plate, wherein turning the eccentric causes the movable plate to be displaced on the base plate in a direction perpendicular to the pivot axis and perpendicular to the door in a closed position thereof.

2. The hinge of claim 1, wherein the aperture of the base plate is elongated and extends parallel to the pivot axis and is adapted to allow the base plate to be displaced relative to the furniture article frame in a direction parallel to the pivot axis and parallel to the door in a closed position thereof by loosening the mounting screw.

3. The hinge of claim 1, wherein the opposing lateral edges of the base plate are bent to form a somewhat Z-shaped cross section.

4. The hinge of claim 1, wherein the movable plate has an aperture formed therein which is somewhat rectangular and larger than the aperture of the base plate.

5. The hinge of claim 1, wherein the eccentric is rotatable about a central axis thereof, and wherein the dowel extends parallel to the central axis of the eccentric and is radially offset therefrom.

6. The hinge of claim 1, wherein the elongated opening in the movable plate extends parallel to the pivot axis.

7. The hinge of claim 1, wherein said adjustment screw further comprises an unthreaded portion proximal to a head of the adjustment screw that engages the unthreaded aperture.

8. The hinge of claim 1, wherein at least one of said first and second adjustment plates further comprises opposing lateral edges and a pair of opposing side members depending therefrom to define a channel for receiving the other adjustment plate.

9. The hinge of claim 1, further comprising a retaining pin extending perpendicular to the adjustment screw and contacting an annular groove circumscribing the adjustment screw.

10. The hinge of claim 1, wherein the adjustment screw has an unthreaded portion distal to a head of the adjustment screw which contacts a raised portion of one of the adjustment plates.

11. The hinge of claim 1, wherein the second adjustment plate further comprises a air of opposing side members that define a channel receiving the first adjustment plate.

12. The hinge of claim 1, wherein the aperture of the first adjustment plate is threaded and the aperture of the second adjustment plate is unthreaded, and the adjustment screw has a threaded shaft portion which is received in the threaded aperture.

13. The hinge of claim 1, wherein longitudinal movement of the adjustment screw is restricted relative to the second adjustment plate by a retaining pin extending perpendicular to the adjustment screw and contacting an annular groove circumscribing the adjustment screw and wherein the retaining pin is secured by end portions inserted in opposing apertures formed in opposing side members of the second adjustment plate.

14. The hinge of claim 1, wherein the adjustment screw comprises an unthreaded portion proximal to a head of the adjustment screw and wherein the unthreaded portion engages the unthreaded aperture of the second adjustment plate.

* * * * *